US008999477B2

(12) United States Patent
Hirth

(10) Patent No.: US 8,999,477 B2
(45) Date of Patent: Apr. 7, 2015

(54) UNIVERSAL MEDICINE BOTTLE ATTACHMENT

(71) Applicant: Frederick A. Hirth, New River, AZ (US)

(72) Inventor: Frederick A. Hirth, New River, AZ (US)

( * ) Notice: Subject to any disclaimer, the term of this patent is extended or adjusted under 35 U.S.C. 154(b) by 129 days.

(21) Appl. No.: 13/854,751

(22) Filed: Apr. 1, 2013

(65) Prior Publication Data

US 2014/0295130 A1 Oct. 2, 2014

(51) Int. Cl.
*G09F 3/00* (2006.01)
*G09F 3/02* (2006.01)

(52) U.S. Cl.
CPC ..... *G09F 3/0294* (2013.01); *G09F 2003/0272* (2013.01); *G09F 2003/0211* (2013.01); *Y10T 428/24008* (2013.01)

(58) Field of Classification Search
CPC ..... G09F 3/0294; G09F 2003/0211; G09F 2003/0272
USPC ..... 428/99; 40/299.01, 310
See application file for complete search history.

(56) References Cited

U.S. PATENT DOCUMENTS

2003/0006161 A1* 1/2003 Moore ..... 206/459.1

* cited by examiner

*Primary Examiner* — Brent O'Hern
(74) *Attorney, Agent, or Firm* — Weiss & Moy, P.C.; Jeffrey D. Moy

(57) ABSTRACT

An apparatus for attachment to a medicine container has a label with label surface such that it can be written upon by hand with a writing instrument. An attachment mechanism is provided which will attach the label to a medicine container. The label surface contains thermochromic material to indicate change in body temperature.

18 Claims, 7 Drawing Sheets

UNIVERSAL MEDICINE BOTTLE ATTACHMENT

TECHNICAL FIELD

A device for attachment to a prescription bottle or medicine bottle is disclosed. The device is an aid to consumers in remembering the purpose of a medication, or for other similar purpose. The device includes an area for a blank label that can be written upon by the consumer or the pharmacist. The device is intended to increase consumer confidence in selecting and taking the correct medicines regularly, and to describe the medicine to the consumer in terms that are understandable, or in a language or words that are an aid to the consumer. The label can be large enough to allow writing in large letters as an aid to persons with poor eyesight. The device includes mechanism in addition to the label for other reminder information related to the regular taking of medicine including a clock-like mechanism for remembering the number of times a medicine has been taken. The device can include physical attributes indicative of the type of medicine contained.

BACKGROUND

Prescription medicines often have names that may not be easily remembered or related by the consumer to the purpose of the drug. Labels on prescription bottles are often printed in smaller letters that are not easily read by older people or people with low eyesight. Some people may take multiple medicines each day which may come in similar packages or have similar, non-distinctive, or not easily remembered names. Many prescriptions or medications are taken regularly for long periods and are refilled on a regular basis such as once a month or once a week.

In the pharmacy, pharmacists are often asked to explain a medication in terms understandable to the consumer. Words such as "heart pill" or "water pill" or "skin cream" or "stomach medicine" may help the consumer understand the medicine more clearly than the medically correct name for a drug such as "potassium" or "hydrochlorothiazide" or "hydrocortisone" or "Zantac" (ranitidine hydrochloride).

The device disclosed as the subject invention is intended as a reusable attachment to a medicine bottle which provides a convenient place for the consumer or pharmacist to write or mark the purpose of the medicine upon the device attached to a medicine bottle. The device itself, or the label, can also include other information such as the number of times to be taken each day. Having a reusable device allows the consumer or the pharmacist to transfer the information to a new bottle when a prescription is refilled.

SUMMARY OF THE INVENTION

An apparatus for attachment to a medicine container has a label with label surface such that it can be written upon by hand with a writing instrument. An attachment mechanism is provided which will attach the label to a medicine container. The label surface contains thermochromic material to indicate change in body temperature.

An apparatus for attachment to a medicine container has a label with label surface such that it can be written upon by hand with a writing instrument. An attachment mechanism is provided which will attach the label to a medicine container. The label surface contains phosphorus material to illuminate the apparatus.

The features, functions, and advantages may be achieved independently in various embodiments of the disclosure or may be combined in yet other embodiments.

BRIEF DESCRIPTION OF DRAWINGS

The subject matter of the invention is particularly pointed out and distinctly claimed in the concluding portion of the specification. The invention, however, both as to organization and method of operation, may best be understood by reference to the following description taken in conjunction with the subjoined claims and the accompanying drawing of which:

DESCRIPTION OF THE APPLICATION

While the principles of the invention have now been made clear in an illustrative embodiment, there will be immediately obvious to those skilled in the art many modifications of structure, arrangements, proportions, the elements, materials, and components, used in the practice of the invention which are particularly adapted for specific environments and operating requirements without departing from those principles.

Figure 1:
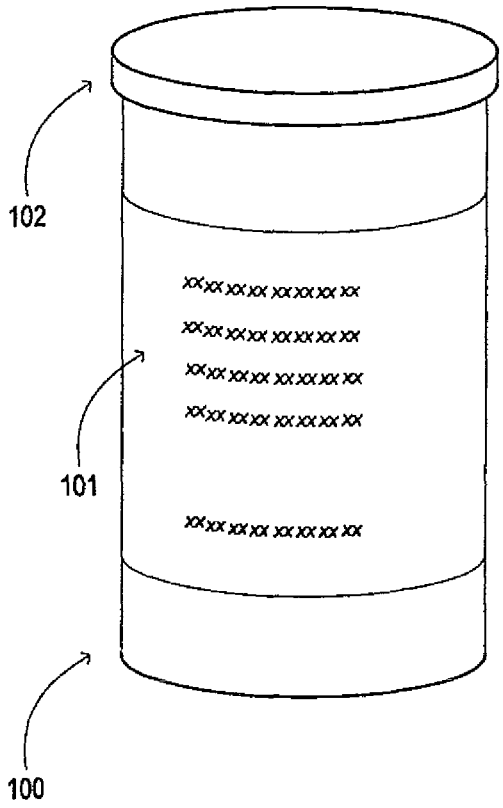
FIG. 1 is a diagram showing a typical medicine bottle of the prior art with standard label affixed by adhesive.

FIG. 1 is a diagram showing a typical medicine bottle 100 of the prior art with standard label 101 affixed to the surface of the bottle by an adhesive. The general overall shape of the exemplary bottle is that of a cylinder closed on one end with a removable cap 102 on the other end. Medicine bottles as used by pharmacies for many medicines, particularly pills, are often formed of plastic and are provided in an assortment of standard sizes and shapes.

Figure 2:
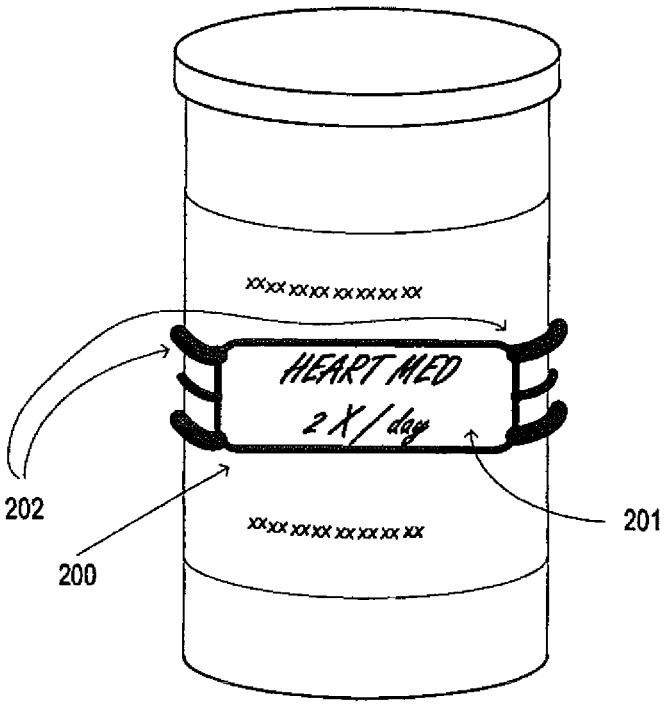
FIG. 2 shows as a first embodiment a medicine bottle with an exemplary label device of the subject invention attached.

FIG. 2 shows a medicine bottle with an exemplary label device 200 of the subject invention attached. The device attaches to the medicine bottle and holds a writable label 201 in a manner such that it is readily examined and viewed. The mechanism for attachment is an extension of the writable consisting of anus 202 that are flexible and which wrap around the bottle to hold the writable label in place. The writable label provides a space for either the consumer or the pharmacist to write, typically in ink, information relating to the medicine in the container to which the device is attached. The writable label provides a means for the medicine to be described in "lay" terms, that is, using terms, writing, and language understandable or useful to a specific consumer or class of consumers. The area of the label is large enough to be easily written upon by hand using a pen or marker.

Figure 3:
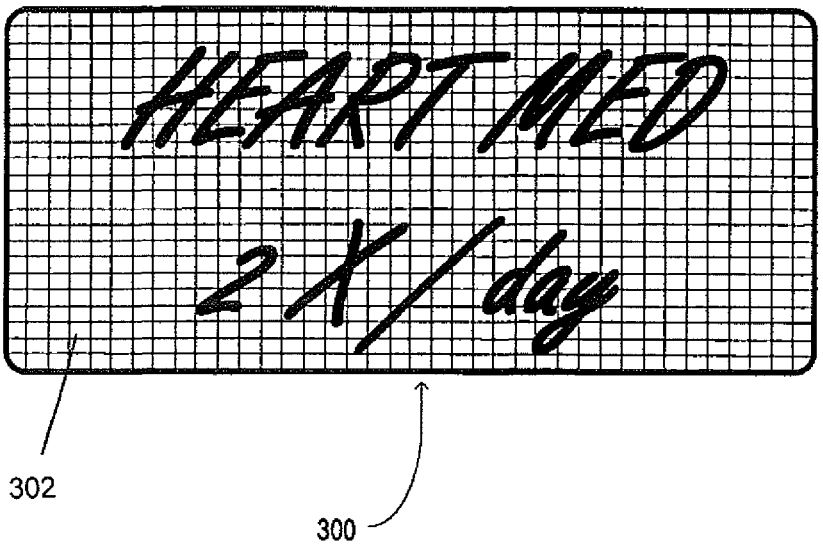
FIG. 3 is a sketch showing the label area provided as part of the label device with an area for writing information about the medicine to which the device will be attached.

FIG. 3 is a sketch showing the surface of the label area 300 provided as part of the label device with an area for writing information about the medicine to which the device will be attached. The surface 300 as shown is textured 302 and of porosity such that the ink of the writing upon the label will not be easily removed or rubbed off during casual handling of the medicine bottle.

Figure 4:
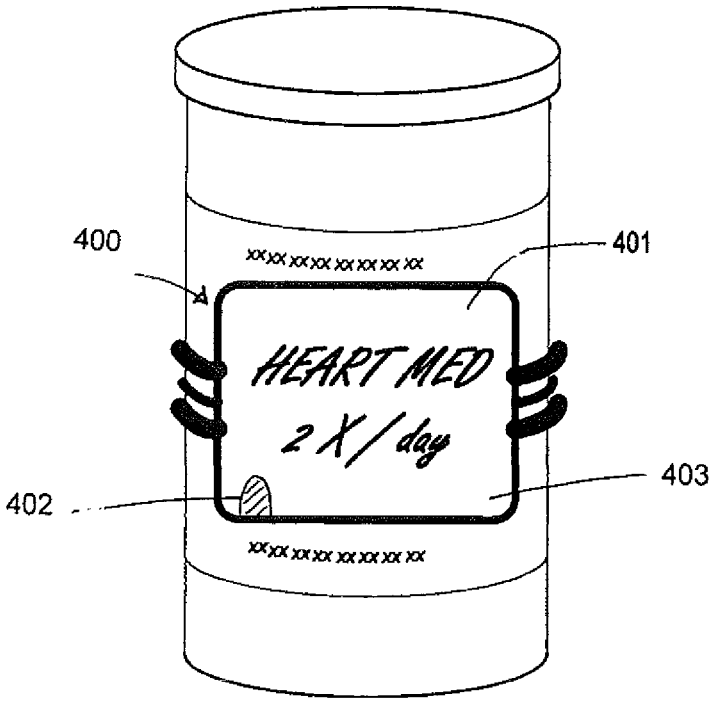
FIG. 4 is a sketch showing an exemplary label device of the subject invention with a larger label providing a larger area of writing to allow larger lettering for consumers with poor eyesight.

FIG. 4 is a sketch showing an exemplary label device of the subject invention with a larger label providing a larger area of writing 400 to allow larger lettering for consumers with poor eyesight.

Figure 5:
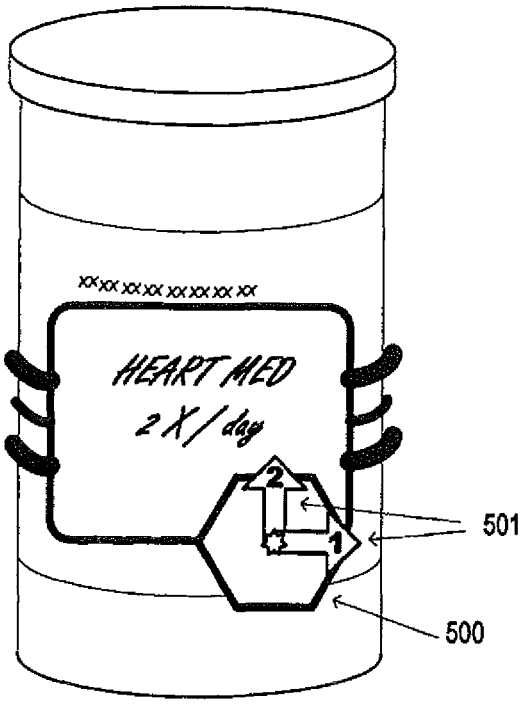
FIG. 5 is a sketch showing an indicative structure that can be part of the label device which provides a mechanical means for remembering how many times a medicine has been taken.

FIG. 5 is a sketch showing the exemplary label device of the subject invention including an indicative structure 500 which is an accounting mechanism. The accounting mechanism is a part of the label device and provides a mechanical means for remembering how many times a medicine has been taken. The exemplary indicative structure in the figure bears resemblance to a clock and the hands of a clock. The hands 501 are moveable. At the beginning of a day, the accounting mechanism is "reset" by putting the "hands" in an upward pointing (12 o'clock) position. Each time a dose of medicine is taken from the bottle, one of the hands is moved down to a position that is not at 12 o'clock. The consumer can thus readily determine how many times the contained medicine has been taken by simply glancing at the position of the hands. Different numbers of hands can be provided depending on the number of dosages for which accounting is desired. Other alternative mechanical means for accomplishing the same accounting are readily apparent and could be provided as an alternative accounting mechanism to the exemplary mechanism here described.

Figure 6:
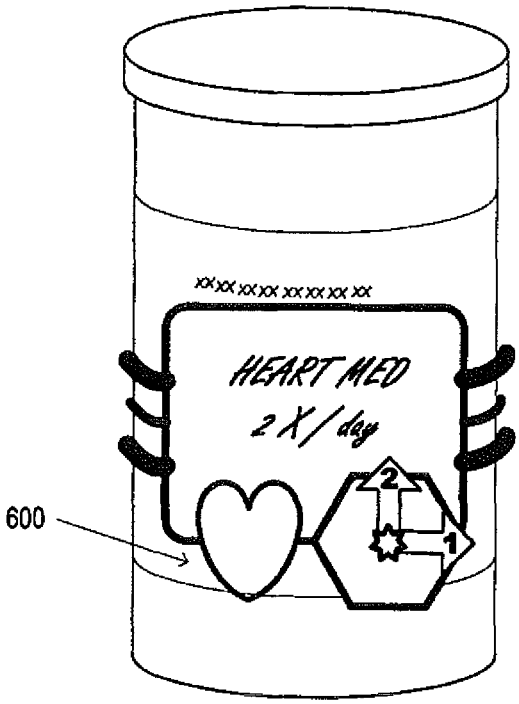
FIG. 6 is a sketch showing an exemplary label device of the subject invention including a second indicative structure that helps the consumer remember the medicine contained in the bottle to which the label device will be attached.

FIG. 6 is a sketch showing the exemplary label device of the subject invention including a second indicative structure 600 that helps the consumer remember the medicine contained in the bottle to which the label device will be attached. This structure could be any shape which reminds the consumer of the intended purpose of the medicine. In FIG. 6 the second indicative structure 600 is in the shape of a heart and reminds the consumer that the medicine bottle contains "heart" medicine.

Figure 7:
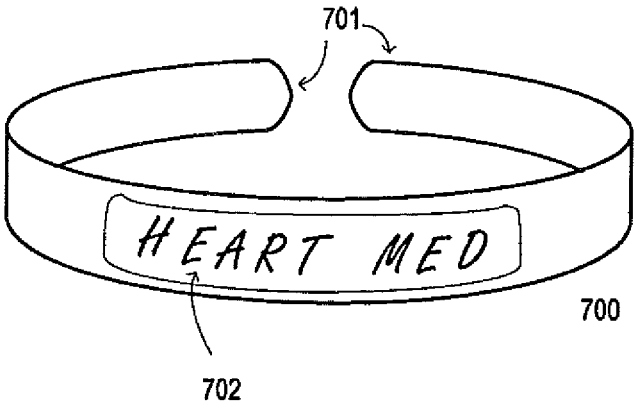
FIG. 7 is a sketch showing a second exemplary embodiment of the invention in which the device for attachment to the medicine bottle is constructed of a single piece of plastic of uniform width, with the plastic molded in a cylindrical shape that can be stretched to fit around medicine bottles of varying size. This second embodiment may be simpler and cheaper to manufacture than the first embodiment as depicted in FIG. 2.

FIG. 7 is a sketch showing a second exemplary embodiment of the invention in which the device for attachment 700 to the medicine bottle is constructed of a single piece of plastic of uniform width, with plastic aims 701 molded in a cylindrical shape that can be stretched to fit around medicine bottles of varying size. The writable surface of the label 702 is also a part of the same single piece of plastic of uniform width. This second embodiment may be simpler and cheaper to manufacture than the first embodiment as depicted in FIG. 2.

Referring to FIGS. 2-7, the label devices shown in. FIGS. 2-7 may be composed of plastics such as Acrylonitrile Butadiene Styrene (ABS) or the like. Other materials may be used without departing from the spirit and scope of the present invention. The label devices should be made of a material that can hold a desired shape but also may be semi-flexible to allow the label devices to fit different size/shape containers. In accordance with one embodiment, the thermochromic dyes may be added when making the label devices. The thermochromic dyes may be added to only the label section or to the entire label device. The thermochromic dyes may allow the label devices to change color upon change in temperature from contact with human skin, i.e. 98 degrees Fahrenheit. This will allow a person to know if he/she has taken the medication contained in medication bottle in which label device is attached.

As shown more clearly in FIG. 4, when a person touches the writing area 401, the area 402 that was touched changes color. Thus, if a person is taking multiple medications and gets confused as to which container of medication has already been taken, the person may look at the writing area 400 to see which ones have has changed color to indicate that the medication was taken.

Alternatively, some medications are known to raise body temperature. Thus, the thermochromic dyes may be used to indicate change in body temperature. For example, thermochromic dyes may be engineered to show one color for normal body temperature, and a second color if the body temperature changes (i.e., raises or goes lower). Thermochromatic Liquid crystals may be used to measure and indicate accurate temperatures, The label devices shown in FIGS. 2-7 may further contain phosphorus resins. The phosphorus resins may be mixed with or without the thermochromic dyes when forming the label devices. The phosphorus resins may be used to allow the label devices to emit a "glow" when sufficient light has radiated the label device that is attached to a medicine bottle. This may allow some increase in aiding a person to see his/her medication bottle with the label device is attached when in an area subnormal lighting, i.e. bathroom during the night.

The label devices shown in FIGS. 2-7 may further have an area 403 which may be used to allow Braille markings to be engraved. Braille symbols and/or words are to be used for people that have no or subnormal vision that are required to take medications. There are no labels today that can be printed from a regular printer that display Braille symbols and/or words in the field of retail pharmacy.

In general terms, the figures of the drawing illustrate a device for attachment to a medicine container. Prescription medicine as it typically comes from the pharmacy is in a medicine bottle labeled with a piece of paper affixed with an adhesive label and placed around and upon the cylindrical surface of the bottle. The writing on the adhesive paper label typically provides a brief description of the medicine and the dosage in terms that are medically correct, but which may be confusing to a consumer, particularly if the patient is elderly or whose first language is not that used on the adhesive label. The subject invention provides a convenient means for either the pharmacist or consumer to attach further written information to the medicine bottle. The information, since it is written by hand, can be large enough and in any form that is helpful to the consumer. A care provider, nurse or relative of the patient would be able to express the description of the medicine in terms that are more understandable to the consumer of the medicine than typically provided by the information on the adhesive paper label.

In addition, the subject invention provides other physical indicators to aid the consumer in taking the correct dosage and the proper medicine. The first indicator is a mechanism for counting the number of times a medicine has been taken. The second indicative indicator is a physical structure which is a physical reminder to the consumer of the type of medicine contained in the bottle to which the label device is attached.

The device of the subject invention is re-usable in that it can be easily detached and moved to a new bottle when a prescription is refilled. The device can also be easily moved to reveal the original adhesive label as typically provided by the pharmacy.

The device can be made in plastic of different colors as a further aid or reminder as to which medicine is contained.

The overall result when using a device of the subject invention is to increase the confidence and accuracy in the taking or use of the medicine contained in the bottle to which the device is attached. The device incorporates several features which together are related to the medicine in any specific bottle to which the device is attached.

Thus, while the principles of the invention have now been made clear in an illustrative embodiment, there will be immediately obvious to those skilled in the art many modifications of structure, arrangements, proportions, the elements, materials, and components, used in the practice of the invention which are particularly adapted for specific environments and requirements of operation without departing from those principles.

What is claimed is:

1. An apparatus for attachment to a medicine container including:

a label with label surface such that it can be written upon by hand with a writing instrument; and an attachment mechanism which will attach said label to a medicine container;

wherein said label surface contains thermochromic material to indicate change in body temperature;

wherein said label surface contains phosphorus material to illuminate the apparatus.

2. The apparatus of claim 1, wherein said label has an area for the printing and display of Braille symbols.

3. The apparatus of claim 1, wherein said label surface is textured to prevent ink applied to said label surface from being removed.

4. The apparatus of claim 1, further comprising a mechanical counting structure to indicate to a consumer a number of times the medicine in the container has been taken.

5. The apparatus of claim 4, wherein said mechanical counting structure includes hands that resemble those of a clock.

6. The apparatus of claim 1, further comprising a medical type indicative structure attached to said label, said medical type indicative structure having a shape representing a purpose for the medicine.

7. The apparatus of claim 1, wherein said attachment mechanism comprises a flexible arm which is capable of wrapping around said medicine container.

8. The apparatus of claim 1, wherein said attachment mechanism comprises a single piece of plastic having arms which can be stretched to fit around medicine bottles of varying sizes.

9. The apparatus of claim 6, wherein said medical type indicative structure is a heart shaped structure indicating the medicine is a heart medicine.

10. An apparatus for attachment to a medicine container including:

a label with label surface such that it can be written upon by hand with a writing instrument; and an attachment mechanism which will attach said label to a medicine container;

wherein said label surface contains phosphorus material to illuminate the apparatus.

11. The apparatus of claim 10, wherein said label has an area for the printing and display of Braille symbols.

12. The apparatus of claim 10, wherein said label surface is textured to prevent ink applied to said label surface from being removed.

13. The apparatus of claim 10, further comprising a mechanical counting structure to indicate to a consumer a number of times the medicine in the container has been taken.

14. The apparatus of claim 13, wherein said mechanical counting structure includes hands that resemble those of a clock.

15. The apparatus of claim 10, further comprising a medical type indicative structure attached to said label, said medical type indicative structure having a shape representing a purpose for the medicine.

16. The apparatus of claim 10, wherein said attachment mechanism comprises a flexible arm which is capable of wrapping around said medicine container.

17. The apparatus of claim 10, wherein said attachment mechanism comprises a single piece of plastic having arms which can be stretched to fit around medicine bottles of varying sizes.

18. The apparatus of claim 15, wherein said medical type indicative structure is a heart shaped structure indicating the medicine is a heart medicine.

* * * * *